US005419303A

United States Patent [19]

Stewart

[11] Patent Number: 5,419,303

[45] Date of Patent: May 30, 1995

[54] ROLLER ARROW GUIDE AND BOW SIGHT

[76] Inventor: Richard J. Stewart, 906 Virginia Ave., Nashville, Tenn. 37216

[21] Appl. No.: 160,745

[22] Filed: Dec. 3, 1993

[51] Int. Cl.[6] ..... F41B 5/22; F41G 1/467

[52] U.S. Cl. ..... 124/44.5; 124/87; 33/265

[58] Field of Search ..... 124/23.1, 24.1, 25.6, 124/86, 87, 88, 44.5; 33/265

[56] References Cited

U.S. PATENT DOCUMENTS

| | | | |
|---|---|---|---|
| 3,285,237 | 11/1966 | Wolfe | 124/44.5 |
| 3,935,854 | 2/1976 | Troncosco, Jr. . | |
| 4,026,032 | 5/1977 | Smith | 33/265 |
| 4,324,221 | 4/1982 | Peck . | |
| 4,587,945 | 5/1986 | Little | 124/87 |
| 4,791,907 | 12/1988 | Corley | 124/44.5 |
| 4,865,007 | 9/1989 | Saunders | 124/44.5 |
| 4,884,347 | 12/1989 | Larson | 33/265 |
| 4,894,921 | 1/1990 | Barlow | 33/265 |
| 4,917,072 | 4/1990 | Chang | 124/44.5 |
| 4,967,722 | 11/1990 | Roberts | 124/44.5 |
| 5,031,601 | 7/1991 | Gunter | 124/44.5 |
| 5,048,193 | 9/1991 | Hacquet | 33/265 |
| 5,085,201 | 2/1992 | Tepper et al. | 124/44.5 |
| 5,249,565 | 10/1993 | Saunders et al. | 124/44.5 |
| 5,261,383 | 11/1993 | Halamay | 124/44.5 |
| 5,285,764 | 2/1994 | Mertens | 124/44.5 |
| 5,327,877 | 7/1994 | Shaw | 124/24.1 |

FOREIGN PATENT DOCUMENTS 56828 10/1890 Germany .

*Primary Examiner*—Randolph A. Reese
*Assistant Examiner*—John A. Ricci
*Attorney, Agent, or Firm*—Richard Litman

[57] ABSTRACT

The present invention includes an arrow guide and bow sight adaptable to right-handed or left-handed archery bows. The arrow guide including a vertical support wheel with a V-shaped groove running along its circumference in which an arrow may rest when shooting. This wheel is designed to spin freely on a support rod, reducing friction imparted to the arrow shaft, thus increasing the accuracy, speed, and power of the archer's shot. For lateral support, two horizontal wheels are positioned to either side of the vertical support wheel to prevent the arrow from falling off of the vertical support wheel when the bow is jarred or when the bow string is quickly drawn back. Also connected to the arrow guide device is a sighting device comprising a multiplicity of sight pins and a vertical cross-hair. The sight pins are vertically adjustable to be calibrated to assorted ranges, and both the pins and the cross-hair are horizontally adjustable to account for windage.

8 Claims, 3 Drawing Sheets

ROLLER ARROW GUIDE AND BOW SIGHT

BACKGROUND OF THE INVENTION

1. Field of the Invention

The present invention relates to archery devices and, more particularly, to an improved arrow guide with a bow sight combined therewith for attachment to archery bows.

2. Description of the Prior Art

Arrow supports have long been used in conjunction with archery bows to aid in the accurate shooting of arrows from archery bows. Similarly, bow sights for aiming at intended targets have also been utilized in the sport of archery. Past arrow supports have ranged from the more conventional arrow rest comprising a simple shelf carved out of the bow stock, to the more elaborate, utilizing wire members or rotatable wheels. Although several such supports have been engendered, few have succeeded in providing the archer with an arrow guide that combines accuracy, adjustability, silentness, and power, features paramount to bow-hunting and competition archery. In addition, very few supports have been conceived that are combined with accompanying sighting devices for aiming at the archer's target.

As aforementioned, several arrow supports have been introduced to remedy problems associated with shooting arrows from an archery bow. U.S. Pat. No. 3,935,854, issued on Feb. 3, 1976, for example, discloses an arrow rest that is comprised of two upwardly extending arms that support the arrow prior to its release. This arrow rest attaches to the bow stock above the grip handle with a vertically aligned mounting plate. The disclosed mounting plate incorporates a horizontal shelf to which the extending arms attach. The arms themselves are constructed of a wire-like material and form a vane in which the arrow may sit prior to and during the shot. In the preferred embodiment, the arms are angled forward, resulting in a nearly horizontal contact area for the arrow shaft. Although the rest satisfactorily supports the arrow, there are no lateral guides provided to keep the arrow from falling from the rest.

Another such arrow support device is shown in U.S. Pat. No. 4,324,221, issued Apr. 28, 1981. The arrow rest described in this patent utilizes a pair of inwardly biased conical facing elements positioned on a horizontal rod extending from the bow sight window. These two elements together form a V-shaped notch in which an arrow may be positioned prior to shooting. Contact between the two conical elements is maintained with compressed coil springs. The arrow rest is configured to dampen arrow oscillations created by the rapid propulsion of the arrow when the bow string is released. While these two facing elements together form a V-shape, they are separable and, therefore, deform as the arrow leaves the bow. Although these deformations are intended to occur, they allow the arrow to move both vertically and horizontally, giving rise to the potential for shooting inaccuracies in both the vertical and lateral directions.

U.S. Pat. No. 4,865,007, issued Sep. 12, 1989, also describes an arrow rest device that uses a V-shaped notch to guide an arrow during its release. In this patent, a notched semi-circular guide block is positioned adjacent the arrow shaft, and rotates about a pivot point, maintaining contact with the arrow shaft as it travels past the bow. A boss is positioned on the opposite side of this guide block which also rotates during arrow passage. This boss is mounted on a lateral arm which also serves as a support for the arrow shaft. The lateral arm is pivotally mounted to a main mounting bracket and is horizontally maintained by the semi-circular guide block. By the time the arrow fletchings approach the arrow rest after the bow string is released, the semi-circular guide block has rotated 180 degrees, clearing itself out of the way and also dropping down the pivotal arm, allowing the arrow fletchings to pass without interference from the rest device. While this configuration utilizes a V-shaped guide-wheel, it does not provide support for the arrow shaft throughout the entire shot, potentially decreasing the accuracy of the shot.

Yet another arrow support is disclosed in U.S. Pat. No. 4,587,945, issued May 13, 1986, which also comprises a sighting device. The arrow support itself is composed of three narrow fins that contact the arrow shaft. The sighting device that accompanies the arrow support is provided in a bracket-and-pin configuration in which a multiplicity of pins may be positioned vertically along a slot cut through the mounting bracket. The fins of the arrow guide are configured such that they will not interfere with the arrow fletchings as the arrow leaves the bow. While this particular configuration does give support to the arrow shaft during the release of the arrow, these fins are fixed and, therefore, create friction between the support and the arrow shaft which may lead to inaccurate shooting and lower arrow velocity. This friction imparted to the arrow shaft is significant in magnitude due to the fact that the fins are long and, therefore, create a large frictional contact area.

Other devices have been patented that disclose mechanisms for sighting and arrow supporting. Such patents, being of only marginal relevance include German Patent No. DE 56828, issued Oct. 18, 1890; U.S. Pat. Nos. 4,026,032, issued May 31, 1977; 4,884,347, issued Dec. 5, 1989; 4,894,921, issued Jan. 23, 1990; 5,048,193, issued Sep. 17, 1991.

Objects of the present invention will become readily apparent upon further review of the following specification and drawings. None of the above inventions and patents, taken either singly or in combination, is seen to describe the instant invention as claimed.

SUMMARY OF THE INVENTION

The present invention relates to an improved arrow support in combination with a bow sight device. The common arrow supports used by most archers today comprise simple two-prong rests between which an arrow shaft may sit. While effectively providing support for the arrow, this type of rest imparts undesired friction to the arrow shaft as the arrow travels along the tips of the prongs. This friction is detrimental to effective shooting in that it both produces drag, preventing the arrow from attaining maximum speed, and causes vibrations within the arrow shaft, causing the arrow shaft to oscillate, thus reducing the accuracy of the archer's shot. In addition, conventional arrow rests provide only minimal lateral support for the arrow, therefore allowing the arrow to easily fall off the rest when the bow is jarred or when rapidly drawing back the bow string.

Other problems exist with arrow rests currently available on the market. For one, few arrow rests are available for left-handed archers and even less are available that are easily reversible from either the right-handed or left-handed configuration. Moreover, very few rests are available with built-in sighting mechanisms. A device encompassing an arrow support and a bow sight in one unit is desirable since such a device expedites the removal of these parts and also lowers the cost to archers who wish to have both an arrow support and a sighting device on their bow.

Due to the insufficiencies of available arrow supports and bow sights, it is the principal object of the invention to provide a combination arrow support and bow sight that is easily reversible between right and left hand positions and that reduces friction between the arrow rest and the arrow shaft, when shooting an arrow.

Accordingly, the invention relates to an arrow support and bow sight, adapted to be secured to the sight window area of an archery bow, which provides a freely rotatable wheel upon which an arrow will rest prior to and immediately after release of the bow string. The above mentioned wheel has a V-shaped notch running along its circumference, providing a stable groove in which the arrow shaft may rest. This "V-wheel" is constructed out of Delrin brand synthetic resin to ensure minimal friction between the rotating wheel and the rod about which it rotates, allowing the wheel to spin freely as the arrow leaves the bow, minimizing the friction commonly associated with shooting from conventional arrow rests.

An additional object of the invention is to provide an arrow rest and sight combination which is located inside the bow. This is advantageous when hunting in the woods, or other places requiring traversing ground having thick underbrush or obtrusive vegetation. This vegetation is easily entangled in apparatus projecting forwardly of the bow. The present invention is designed to keep its components inside the bow.

It is another object of the invention to provide an arrow support with lateral support members comprising wheels made from a synthetic polymer, one positioned on either side of the central "V-wheel." These two horizontal wheels provide lateral support to the arrow shaft in case the arrow is jarred out of the V-shaped groove, preventing the arrow from falling from the support and allowing the archer to quickly replace the arrow shaft into position. In addition, the two lateral wheels serve the ancillary purpose of indicating bow mis-alignment, this becoming apparent when arrows continually strike these horizontal wheels when shot from the bow.

It is another object of the invention to have an arrow support provided with a sighting device which comprises a multiplicity of threaded sight pins, vertically adjustable for aiming at targets at assorted ranges. The sighting device also includes a vertical cross-hair housed within a laterally adjustable cross-hair frame, such adjustability being accomplished with a central bolt member threaded into the sight pin bracket.

It is another object of the invention to provide a combination bow sight and arrow rest which is reversible between a right-handed bow and a left-handed bow, and which also accommodates different bows, by utilizing removable or adjustable fasteners.

It is a further object of the invention to provide improved elements and arrangements thereof in an apparatus for the purposes described which is inexpensive, dependable and fully effective in accomplishing its intended purposes.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
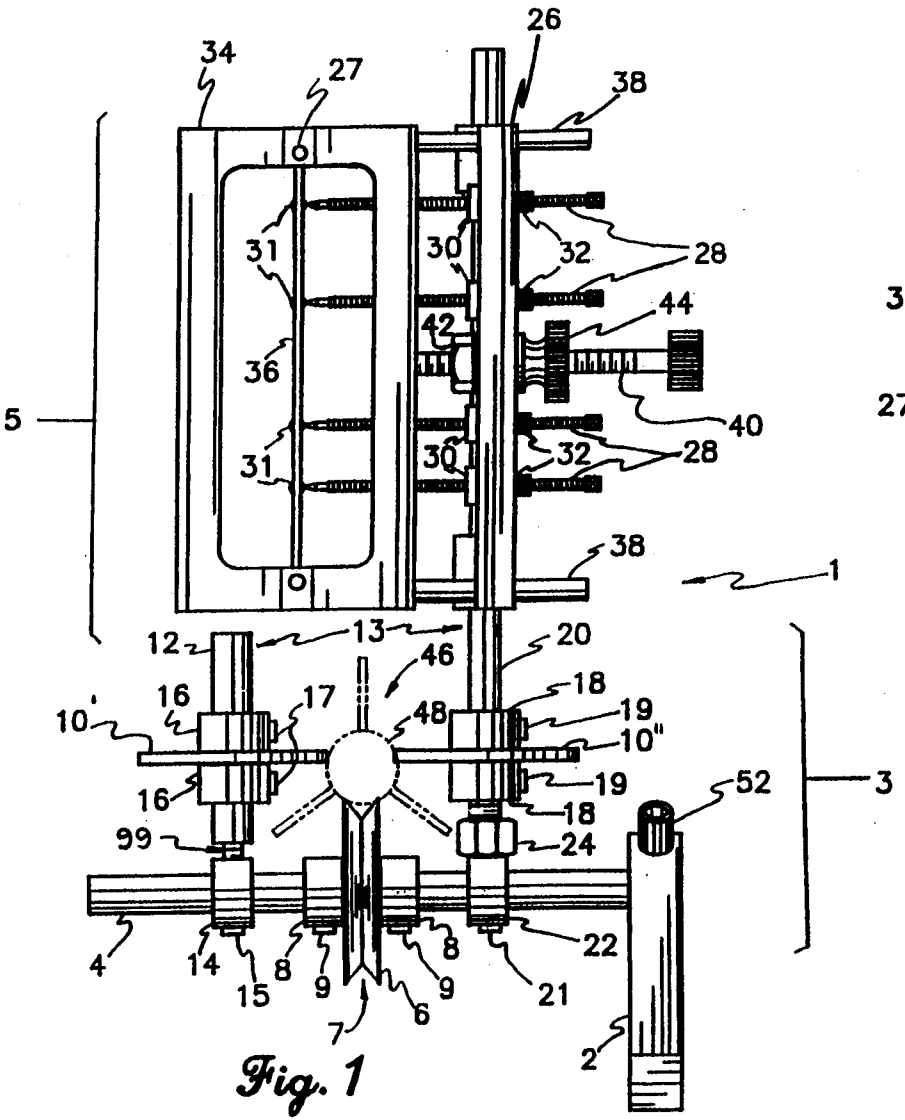
FIG. 1 is a front view of an arrow support and bow sight embodying the present invention with the bow not shown.

FIG. 1 illustrates a preferred embodiment of the invention as it would attach to a right-handed archery bow. Although this embodiment is configured for a right-handed bow, the invention is easily adaptable to a left-handed bow. The arrow guide and bow sight designated generally 1 includes a mounting bracket 2 which connects the arrow guide and bow sight 1 to the sight window of an archery bow not shown.

Figure 2:
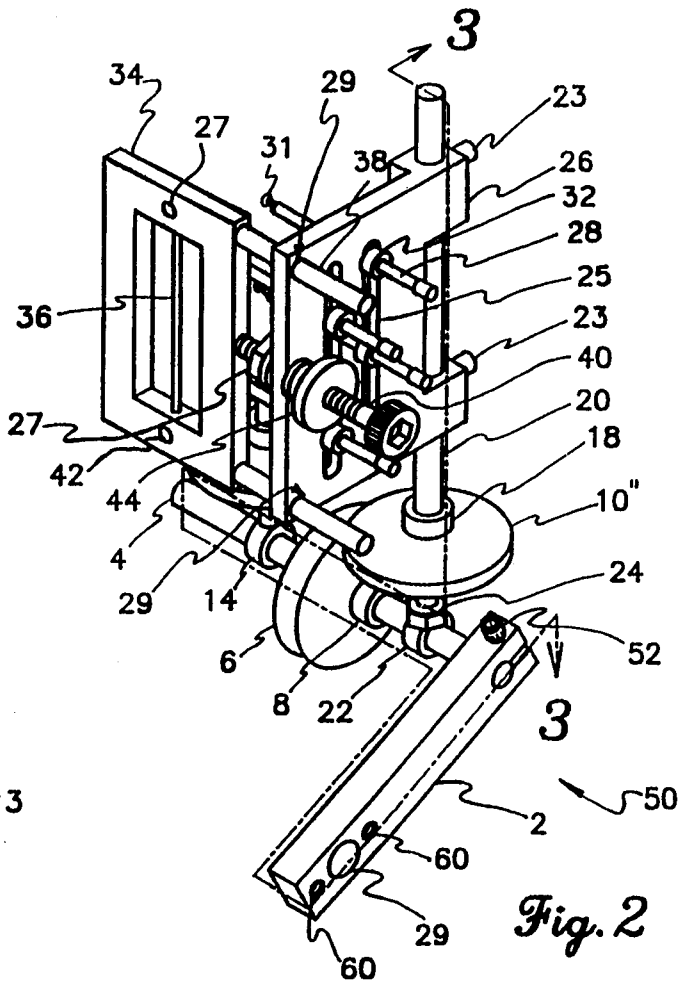
FIG. 2 is a reduced perspective view of the arrow guide and bow sight illustrated in FIG. 1, taken from the right of FIG. 1.
Figure 3:
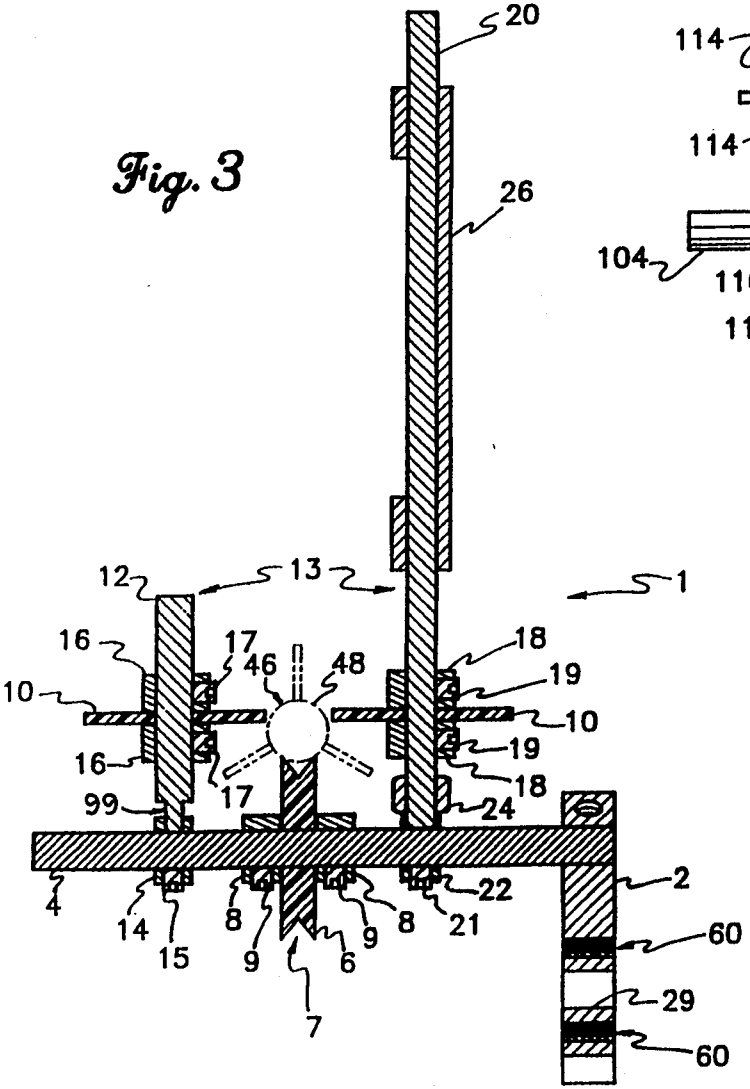
FIG. 3 is a sectional view drawn along lines 3—3 of FIG. 2.

As shown in FIGS. 2 and 3, the mounting bracket 2 has drilled therethrough a hole 29 that may accept a mounting bolt (not shown) to secure the arrow guide and bow sight 1 to the sight window. A support rod 4 extends from the mounting bracket 2 which provides support for the arrow guide designated in FIG. 1 generally 3. In the center of the support rod 4 is positioned a vertical support wheel 6 made of Delrin brand synthetic polymer that has a V-shaped notch 7 along its entire circumference to hold an arrow 46 in place when shooting. The vertical support wheel 6 is kept in place with two rod collars 8..8 positioned on either side of the vertical support wheel 6. Each of the rod collars 8..8 is affixed to the support rod 4 with hexagonal set screws 9..9.

Positioned to either side of the vertical support wheel 6 are two lateral guide wheels 10' and 10'', again constructed of Delrin. These lateral guide wheels 10! and 10'' are supported by vertical support members designated generally 13..13. The left lateral guide wheel 10' is mounted to a vertical support rod 12 which attaches to the support rod 4 with a mounting collar 14, screwing into mounting collar 14 with a threaded tip portion 99. The mounting collar 14 is itself secured to the support rod 4 via a hexagonal set screw 15. Similar to the vertical support wheel 6, the left lateral guide wheel 10' is held in position with two adjacent rod collars 16..16, themselves retained by hexagonal set screws 17..17.

The right lateral guide wheel 10'' is similarly mounted to mounting shaft 20 with rod collars 18..18 and hexagonal set screws 19..19 adjacent either side of guide wheel 10''. The mounting shaft 20 also screws into a mounting collar 22 fixed in place with lock nut 24.

The mounting collar 22 affixes to support rod 4 with hexagonal set screw 21.

Also attached to the mounting shaft 20 is the bow sight designated generally 5. As shown in FIG. 2, the bow sight 5 comprises a sight bracket 26 which engages the mounting shaft 20, affixed to it with two hexagonal set screws 23..23. The sight bracket 26 has vertical slots 25..25 which serve to house the sight pins 28..28. As revealed in FIG. 1, these sight pins 28..28 are equipped with threads which engage pin brackets 30..30 and knurled lock nuts 32..32 to secure the sight pins 28..28 in their positions along the vertical slots 25..25.

In addition to the sight pins 28..28, a cross hair frame 34 is mounted to the sight bracket 26 to aid in aiming at a target. A vertical cross-hair 36 is held in place within the cross hair frame 34 with set screws 27..27. The cross hair frame 34 is laterally adjustable, sliding toward or away from the sight bracket 26 on two dowel pins 38..38 that are inserted into correlating holes 29..29 located in the sight bracket 26, by using an adjustment bolt 40 secured in place by lock nuts 42 and 44.

As previously described, the arrow guide 3 is designed to increase both shot accuracy and arrow speed. When the archer is prepared to shoot at a target, an arrow 46 is placed on the vertical support wheel 6. The arrow notch 7 operates to keep the arrow in place, preventing it from shifting from side to side. The vertical support wheel 6, being composed of Delrin, rotates smoothly along the support rod 4 while the arrow 46 is drawn back and when it is shot. If the bow were to be suddenly moved or jarred, knocking the arrow from the V-shaped groove 7 of the vertical support wheel 6, the lateral guide wheels 10' and 10'' act as guard rails, preventing the arrow 46 from dropping completely off the vertical support wheel 6 and allowing the archer to quickly replace the arrow 46 to its correct position. This feature of the invention is especially helpful to the inexperienced archer, it being difficult and time consuming to have to re-align a dropped arrow. As the arrow 46 accelerates after the bow string is released, the vertical support wheel 6 spins freely along with the passing arrow shaft 48. The vertical support wheel 6 rotates about the support rod 4 with very little friction, the rod 4 being composed of metal and the vertical support wheel 6 being composed of Delrin or like synthetic polymer material. This decreased friction translates to less friction between the vertical support wheel 6 and the arrow shaft 48.

As previously discussed, friction between an arrow rest and an arrow decreases the accuracy of the shot by causing vibrations in the shaft of the arrow, causing it to fly less efficiently. In addition, friction reduces the speed of the arrow by placing a force opposing the arrow's direction of flight. By imparting less friction to the arrow shaft, the arrow may be shot with greater accuracy, speed, and power.

In addition to the above described advantages of the arrow guide 3, the lateral guide wheels 10' and 10'' may also be used to indicate if the bow is out of tune and in need of adjustment. Misalignment is indicated to the archer when the arrow 46 hits the guide wheels 10' and 10'' when it is shot from the bow. Such contact alerts the archer that the bow needs lateral adjustment, revealing the cause of shooting inaccuracies.

The sighting mechanism 5 shown in FIG. 1 comprises a sight pin configuration in which a multiplicity of sight pins 28..28 are aligned vertically, each calibrated to different ranges, typically 20, 30, 40, and 50 yards. Once the sight pins 28..28 are calibrated, the archer aligns the sighting bead 31 of the appropriate sight pin 28 with the vertical cross-hair 36 on the intended target downrange. Adjustment of the sight pins 28..28 is accomplished by simply loosening the securing nuts 32..32, repositioning the sight pin, and then re-tightening nuts 32..32. As for the cross-hair 36, lateral adjustment is achieved by loosening nuts 42 and 44 that secure adjustment bolt 40, repositioning the cross hair frame 34 to the left of right, and again re-tightening nuts 42 and 44.

Substitution of a cross hair sight employing two cross hairs (not shown), in lieu of the arrangement discussed above wherein sight pins 28...28 are included, would yield the same results with respect to efficacy. Sight pins are discussed merely to present in detail one mode of practicing the present invention.

As previously mentioned, the preferred embodiment shown in FIG. 1 is completely reversible to accommodate right-handed or left-handed bows. Once the arrow guide and bow sight 1 has been removed from the bow, this reversal is achieved by first loosening hexagonal set screws 15 and 21. Collars 14 and 22 are then rotated into correct position about support rod 4 and then set screws 15 and 21 are again tightened. Next, the sight bracket 26 is removed from vertical support shaft 20 by loosening set screws 23..23. Finally, the sight bracket 26 is rotated 180 degrees, turning it upside down, and is then replaced onto the vertical support shaft 20 securing it in placed by re-tightening the set screws 23..23. The arrow guide and bow sight 1 is then ready to be used by the archer.

Figure 4:
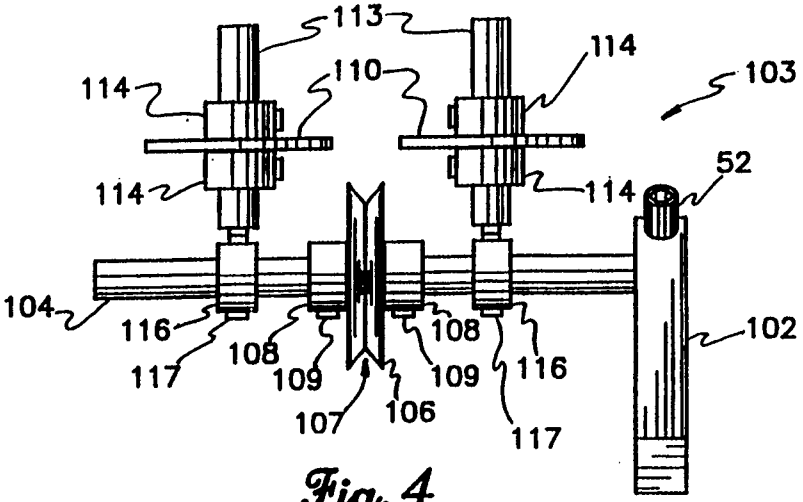
FIG. 4 is a front view of another embodiment of the invention.

FIG. 4 shows a second embodiment in which a bow sight is not included with the arrow guide 103. In this embodiment, a mounting bracket 102 is mounted to a sight window of an archery bow. A support rod 104 extends laterally from the mounting bracket 102 and a vertical support wheel 106 is placed halfway along support rod 104. This vertical support wheel 106 has a V-shaped notch 107 that runs along its circumference to house an arrow shaft. Adjacent either side of the vertical support wheel 106 are rod collars 108..108 which attach to the support rod 104 with hexagonal set screws 109..109. To either side of the vertical support wheel 106 are two lateral guide wheels 110..110 which are mounted to vertical support rods 113..113. The lateral guide wheels 110..110 are kept in position by two rod collars 114..114 placed on either side of each wheel 110..110. The two vertical support rods 113..113 attach to the support rod 104 with set collars 116..116 which are fixed into place with hexagonal set screws 117..117.

The arrow guide 103 functions identically as does arrow guide 3 of the primary embodiment illustrated in FIG. 1. As with the primary embodiment, the arrow guide 103 of the second embodiment can be adjusted to fit both right-handed and left-handed bows. Once the arrow guide 103 is removed from the bow, reversal is accomplished by first loosening set screws 117..117 and rotating collars 116..116 into position. Once vertically aligned, the vertical support rods are fixed by re-tightening set screws 117..117. The arrow guide 103 can then be placed on another bow and securely tightened into place.

Figure 5:
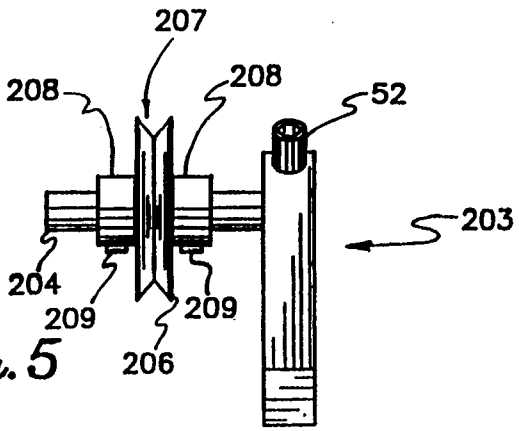
FIG. 5 is a front view of still another embodiment of the invention.

A third embodiment is shown in FIG. 5 in which arrow guide 203 comprises a vertical support wheel 206 positioned along a support rod 204 which connects to a bow with a mounting bracket 202. Identical to the other two described embodiments, the vertical support wheel 206 has a V-shaped groove 207 and functions to reduce arrow friction when shooting. The vertical support wheel 206 is kept in place along the support rod 204 with two adjacent collars 208..208 locked onto the support rod 204 with hexagonal set screws 209..209.

Again, this embodiment may be easily adapted to either a left-handed bow by removing the arrow rest 203 from the archery bow, turning the mechanism over, and simply replacing it onto a different bow.

Figure 6:
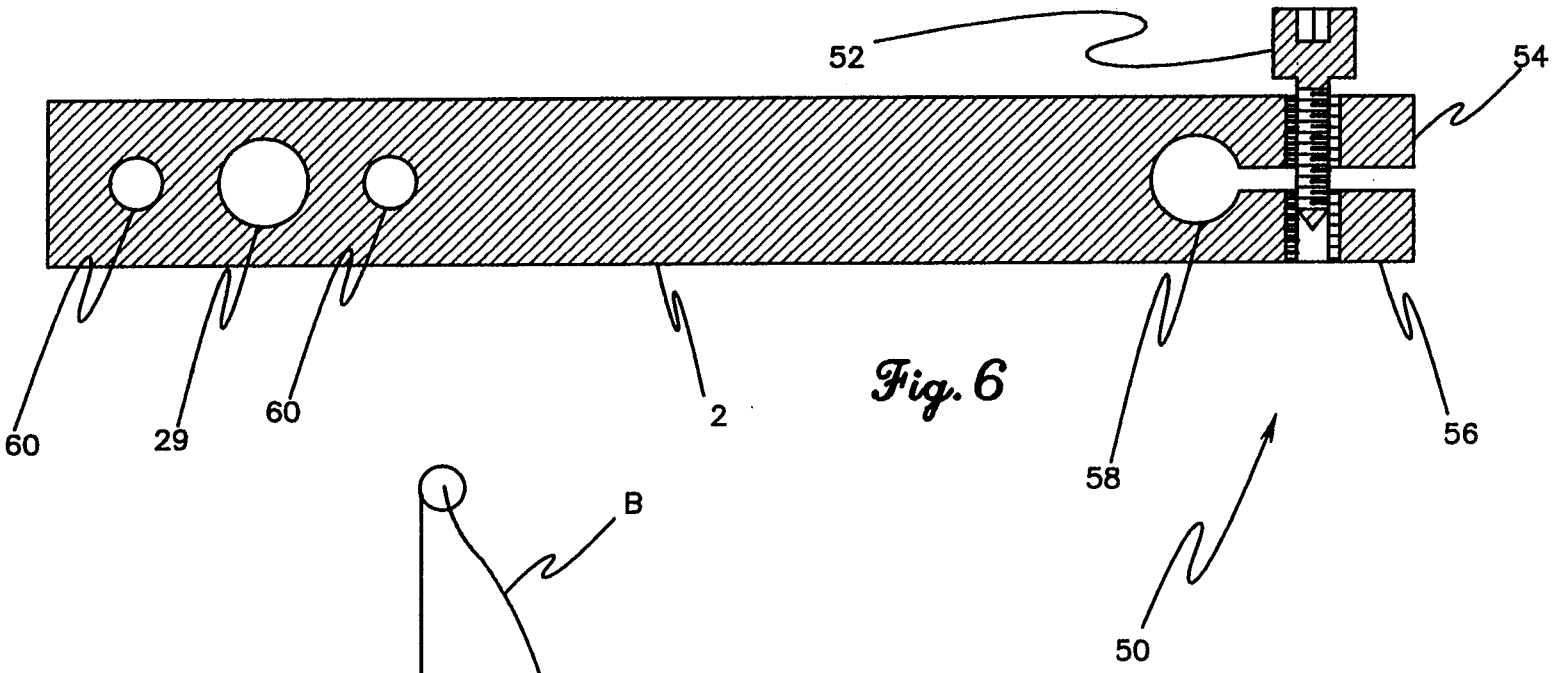
FIG. 6 is a cross sectional detail view of an alternative embodiment of the mounting arm, drawn to enlarged scale.

According to a preferred embodiment, illustrated in FIG. 6, mounting bracket 2 is formed to include a clamping arrangement 50, seen at the right in this figure. A screw 52 draws top jaw 54 towards bottom jaw 56 when tightened, thus pinching a shaft (not shown) in bore 58. This arrangement is preferred over setscrews which have been included for clarity elsewhere in this specification. Both the clamping arrangement and setscrews are examples of removable clamping securement means which will affix components of the present invention to shafts or rods. The reason that clamping arrangement 50 is preferable is that a shaft pinched therein is not scratched or otherwise distorted, as would tend to occur with a setscrew.

FIG. 6 also shows a preferred arrangement for attachment to the bow (not shown). In addition to hole 29, threaded holes 60 are provided to accommodate setscrews or similar fasteners (not shown) for steadying or solidifying attachment to the bow.

Figure 7:
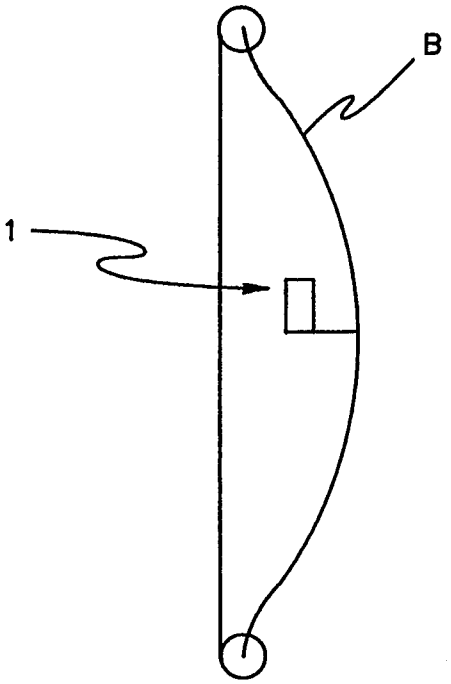
FIG. 7 is a diagrammatic, environmental, side elevational representation of the location of the invention with respect to a bow.

The invention 1 is shown relative to a bow B in diagrammatic form in FIG. 7. The location is within the bow B, so that it is located closer to the user's eye than if placed forwardly of the bow B. This location is also somewhat sheltered against incidental contact with underbrush or other vegetation, as is frequently encountered while hunting in forests and the like.

It is to be understood that the present invention is not limited to the embodiments described above, but encompasses any and all embodiments within the scope of the following claims.

We claim:

1. A reversible arrow guide for mounting to an archery bow having a cutout section including a sight window having a flat surface, said reversible arrow guide comprising:

a) a bracket element secured to the archery bow at a sight window area and having a flat wall mounting flush against the flat surface of the sight window;

b) a rod element extending horizontally from said bracket element such that said rod element is perpendicular to said bracket element;

c) an arrow support element positioned about said rod element, thus providing support for an arrow shaft;

d) two lateral guides, each positioned on one side of said arrow support element, extending vertically from said rod element, each fastened thereto with a collar member having removable clamping securement means.

2. The reversible arrow guide according to claim 1, wherein said arrow support element comprises at least one freely rotatable wheel composed of a synthetic polymer material, having a circumference and means defining a V-shaped notch about said circumference, thereby providing a groove in which an arrow may rest.

3. The reversible arrow guide of claim 2, further including collar members, wherein said rotatable wheel is positioned between two said collar members, each said collar member being affixed to said rod element by removable clamping securement means.

4. The reversible arrow guide according to claim 1, wherein each of said two lateral guides includes a vertical rod member, each vertical rod member having a freely rotatable wheel.

5. A reversible arrow guide for mounting to an archery bow having a cutout section including a sight window having a flat surface, said reversible arrow guide comprising:

a) a bracket element secured to the archery bow at a sight window area and having a flat wall mounting flush against the flat surface of the sight window;

b) a rod element extending horizontally from said bracket element such that said rod element is perpendicular to said bracket element;

c) an arrow support element positioned about said rod element, thus providing support for an arrow shaft, said arrow support element comprising at least one freely rotatable wheel secured thereto;

d) two lateral guides, each positioned on one side of said arrow support element, extending vertically from said rod element, each fastened thereto with a collar member having removable clamping securement means; and e) a sighting device including means for aiming an arrow at an intended target, said sighting device being attached to one of said two lateral guides.

6. The reversible arrow guide according to claim 5, wherein each of said two lateral guides includes a vertical rod member, each vertical rod member having a freely rotatable lateral wheel.

7. The sighting device according to claim 6, further including a mounting plate including a plurality of threaded sight pins secured thereto and flanged nut members and knurled nut members, said mounting plate having means defining two longitudinal slots through which said sight pins engage said flanged nut members and said knurled nut members, thereby retaining said sight pins in fixed positions along said longitudinal slots.

8. The sighting device according to claim 7, further including a cross-hair and a cross-hair frame secured to said mounting plate, there further being a bolt threaded through said mounting plate and two lock nuts attaching to said cross-hair frame, for laterally adjusting said cross-hair and cross-hair frame, and two dowel pins, each placed at one end of said cross-hair frame, said dowel pins acting as guide arms when said cross-hair frame is adjusted selectively toward and away from the archery bow.

* * * * *